United States Patent [19]

Walker

[11] 4,354,583

[45] Oct. 19, 1982

[54] CARRIER FOR GARMENT BAGS AND THE LIKE

[76] Inventor: Brooks Walker, 1280 Columbus Ave., San Francisco, Calif. 94133

[21] Appl. No.: 293,364

[22] Filed: Aug. 17, 1981

[51] Int. Cl.[3] ..... A45C 5/14

[52] U.S. Cl. ..... 190/18 A; 280/47.26

[58] Field of Search ..... 190/18 A, 18 R; 280/47.24, 47.26

[56] References Cited

U.S. PATENT DOCUMENTS

| | | | |
|---|---|---|---|
| 2,208,347 | 7/1940 | Stuart | 280/47.26 X |
| 2,482,848 | 9/1949 | Grant | 280/47.26 |
| 3,448,839 | 6/1969 | Lugash | 190/41 B X |

*Primary Examiner*—Donald F. Norton

[57] ABSTRACT

A carrier for use with a garment carry-on bag includes a wheeled support for the bottom end of the bag when the latter is in unfolded condition. An elongated vertically extending member is connected at its lower end to the axle of the wheeled support and formed at its upper end to provide a handle. The member and the axle are positioned substantially entirely within the bag.

2 Claims, 6 Drawing Figures

CARRIER FOR GARMENT BAGS AND THE LIKE

This invention relates to a carrier particularly adapted for use with a garment carry-on bag of the type commonly employed by airplane passengers.

It is becoming more and more desirable for an airplane passenger to be able to carry a garment bag of the subject type on to an airplane and it is becoming less and less necessary to be able to carry such a bag in its folded condition.

Not only does the use of a garment bag in its unfolded condition preserve the contents against damage and wrinkling but it becomes a simple matter to hang up the bag on a rod, door or hook for storage.

The main object of the present invention is to improve the use of garment bags of the subject type and at the same time provide a carrier which is light in weight and efficient in use.

Another object of the invention is the provision of a wheeled garment bag which is extremely stable in use and which includes a carrier which is substantially entirely positioned within the bag in such a way as not to impair the normal use of the bag.

Other objects and advantages will be apparent from the following specification and drawings.

Figure 1:
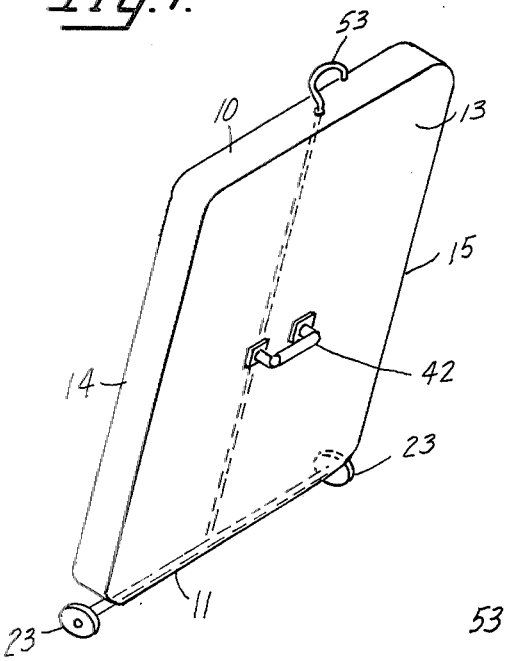
FIG. 1 is an isometric view of a typical garment bag with the invention in use for transporting the bag on wheels.
Figure 2:
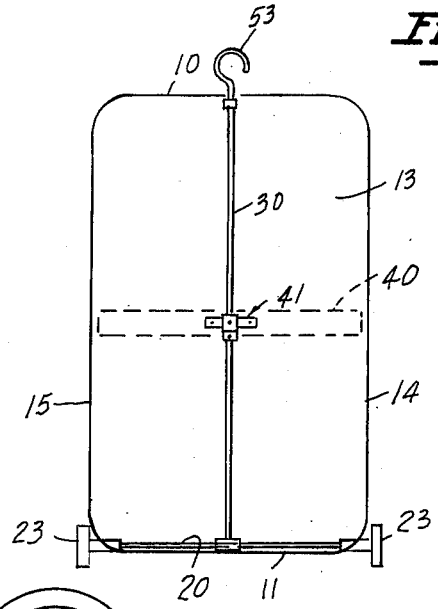
FIG. 2 is a front elevation of the garment bag with the front side removed to show the invention as applied.
Figure 4:
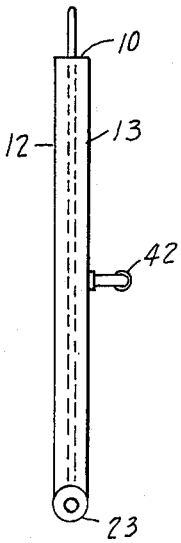
FIG. 4 is an edge view of the structure of FIG. 1.
Figure 3:
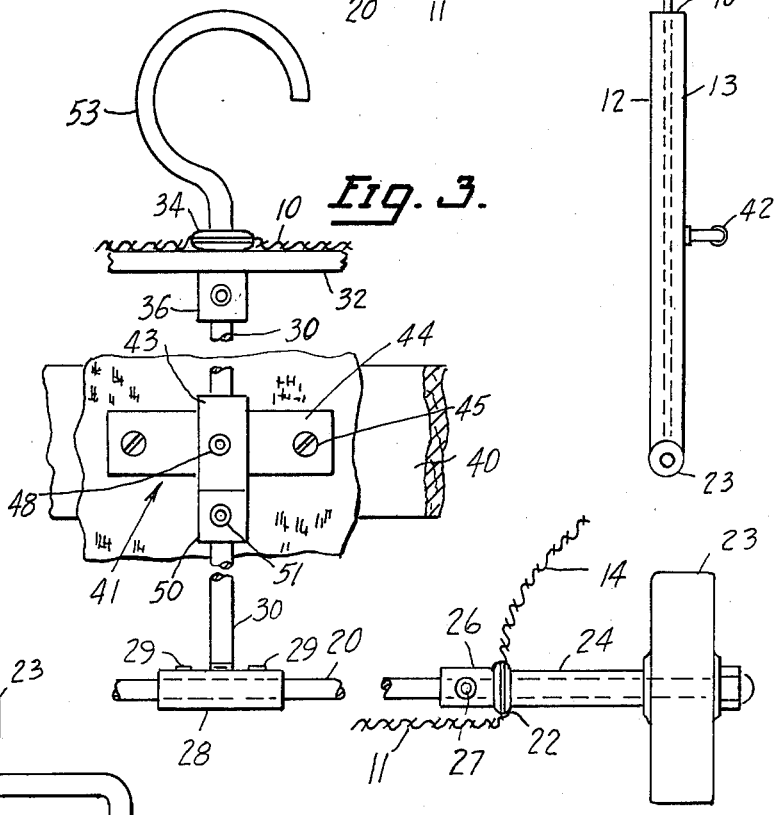
FIG. 3 is a greatly enlarged fragmentary view of the salient parts of the structure of FIG. 2.

In detail, the invention is adapted to be used with a conventional garment bag having top and bottom sides 10,11, and front and rear sides 12,13 (FIG. 4). Connecting the front and rear sides 12,13 and in continuation of the top and bottom sides are vertically extending side edges 14,15.

Garment bags of this type normally include a large zippered compartment for suits, dressed and the like on one side and smaller compartments for shoes, shirts and the like on the opposite side. Such compartments are not shown on the drawings as they vary substantially according to manufacturer and are not involved in the present invention.

By the present invention a wheeled support is provided adjacent the bottom side 11 of the garment bag. Said support includes an elongated axle 20 extending alongside the bottom side of the bag and within the latter. Said axle extends through the side edges of the bag, which are preferably provided with grommets 22 for receiving said axle therethrough, and is provided with ground wheels 23 at its opposide ends. To space the wheels from the material of the bag sleeves 24 are provided on axle 20.

To properly position the axle 20 with respect to the bag a cylindrical sleeve 26 is secured to axle 20 by set screw 27—preferably of the "Allen" type. Centrally of axle 20 is another sleeve 28 secured by set screws 29 and which sleeve is tapped radially to threadedly receive therein the lower end of a vertically elongated member or rod 30.

The rod 30 extends upwardly along the vertical extent of the bag and through the top 10 as well as through the usual stiffening member 32—usually of fiber or like material which is provided alongside said top. A grommet 34 may be secured to top 10 for receiving rod 30 therethrough. Under the stiffener 32 a sleeve 36 is secured to rod 30 so as to transfer some of the weight of the bag to top 10.

In the conventional garment bag such as that disclosed there is usually provided a transverse stiffener 40 of wood or like material which is secured within two layers of material as by stitching. This stiffener 40 serves to secure a handle 42 to the rear side 13 of the garment bag as by screws or rivets etc. (not shown).

By the present invention part of the weight of the bag is transferred from stiffener 40 to the rod 30 by means of a bracket 41 formed with a sleeve 43 and a securing plate 44. Said plate 44 is secured by screws 45 or other suitable mounting to stiffener 40 and the bracket is secured to the rod 30 by set screw 48. Additional strength may be obtained by connecting a collar 50 under bracket 42 and securing it to rod 30 by set screw 51.

The upper end of rod 30 which extends outside the garment bag is bent to form a hook 53 which is used, not only to hang the bag, but to permit the user to manually manipulate the bag when it is being wheeled.

As best seen in FIG. 4 the garment bag may be carried if desired, when not being wheeled, merely by placing the upper end of the bag under the user's arm and grasping the handle 42. When not in use, handle 42 lies flat on the bag.

Figure 5:
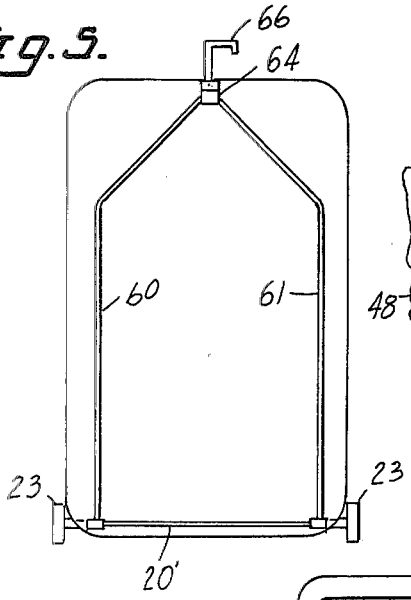
FIG. 5 is a view similar to FIG. 2 showing a modified form of the invention.
Figure 6:
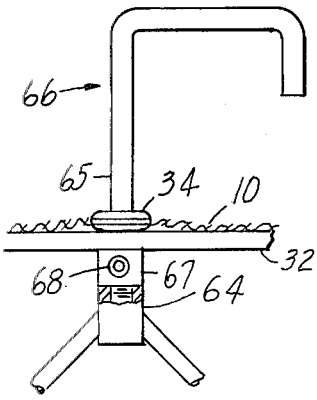
FIG. 6 is a greatly enlarged view of the upper end of the carrier in FIG. 5.

Another form of the invention is shown in FIGS. 5,6. In this case, in lieu of the central rod 30 a pair of lighter weight rods 60,61 are secured at their lower ends to axle 20' and extend upwardly adjacent the side edges of the bag and then slantingly inwardly and are secured as by welding to a cylindrical member 64 (FIG. 6). This member 64 is tapped axially to threadedly receive therein the lower end of the shank 65 of a hook 66. In this case the hook 66 is shown as the square type suitable for hanging the bag on the top of a door. In such a case the construction permits swivelling action of the hook to permit hanging the bag on a rod or the top of a door.

Intermediate the member 64 and the stiffener 32 of the top of the bag is a sleeve 67 secured to shank 65 by set screw 68. By this structure the entire weight of the bag is transferred to the hook 66 and the spaced apart rods 60,61 add to the stability of the bag as well as helping to maintain its shape.

I claim:

1. In combination with a generally rectangular elongated garment carry-on bag, a carrier for said bag comprising:

a wheeled support positioned at the bottom end of said bag, said support including a horizontally extending axle positioned within said bag and extending through the opposite vertically extending side edges of said bag, a vertically extending elongated member positioned within said bag and connected at its lower end to said axle and extending at its upper end through the upper end of said bag, a second vertically extending elongated member connected to said axle with said two members being adjacent the vertically extending side edges of said bag and connected together adjacent said upper end of said bag.

2. In combination with a generally rectangular elongated garment carry-on bag, a carrier for said bag comprising:

a wheeled support positioned at the bottom end of said bag, said support including a horizontally extending axle positioned within said bag and extending through the opposite vertically extending side edges of said bag, a vertically extending elongated member positioned within said bag and connected at its lower end to said axle and extending at its upper end through the upper end of said bag, said bag being formed with a horizontally extending stiffener on one side thereof, and means fixedly securing said member to said stiffener.

* * * * *